US012569067B2

(12) United States Patent
McFadden

(10) Patent No.: US 12,569,067 B2
(45) Date of Patent: Mar. 10, 2026

(54) CHAIR AND CHAIR FRAME

(71) Applicant: Walmart Apollo, LLC, Bentonville, AR (US)

(72) Inventor: Michael Lennis McFadden, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 229 days.

(21) Appl. No.: 18/365,935

(22) Filed: Aug. 4, 2023

(65) Prior Publication Data

US 2025/0040713 A1 Feb. 6, 2025

(51) Int. Cl.

| | |
|---|---|
| ***A47C 4/28*** | (2006.01) |
| ***A47C 4/46*** | (2006.01) |
| ***A47C 7/62*** | (2006.01) |

(52) U.S. Cl.

CPC ..... *A47C 4/286* (2013.01); *A47C 4/46* (2013.01); *A47C 7/626* (2018.08)

(58) Field of Classification Search

CPC ..... A47C 4/286

See application file for complete search history.

(56) References Cited

U.S. PATENT DOCUMENTS

| | | | |
|---|---|---|---|
| 6,095,607 | A | 8/2000 | Wenzel |
| 6,247,749 | B1 | 6/2001 | Yu |
| D607,221 | S | 1/2010 | Shen |
| 8,157,326 | B2 | 4/2012 | Raymond |
| 8,459,741 | B2 | 6/2013 | Mazzola et al. |
| 10,750,871 | B1 | 8/2020 | Smith |
| D927,211 | S | 8/2021 | Chang |
| 2004/0189062 | A1 | 9/2004 | Knight et al. |
| 2008/0084104 | A1 | 4/2008 | VanHorn |
| 2008/0179933 | A1 | 7/2008 | Puccio |
| 2010/0084523 | A1 | 4/2010 | Lasley |
| 2014/0339859 | A1 | 11/2014 | Holland et al. |

FOREIGN PATENT DOCUMENTS

| | | | |
|---|---|---|---|
| CN | 302719139 | S | 1/2014 |
| CN | 305278199 | S | 7/2019 |

OTHER PUBLICATIONS

Unknown, "Yizi-Go-Plus: Portable Camping Chair with Adjustable Height", Trekology, 2023, captured Jun. 7, 2023, https://trekology.com/products/yizi-go-plus-compact-portable-camping-chair-with-adjustable-height?variant=39336979726402, pp. 1-2.

Unknown, "Ultimate 4 Position Outdoor Fishing Chair", Earth Products, (Link 1), date unknown, 3 pages.

Unknown, Earth Products Store Ultimate 4-Position Adjustable Outdoor Fishing Chair w/Adjustable Front Legs—300LBS (Max Load), Amazon, (Link 2), date unknown, 6 pages.

*Primary Examiner* — Anthony D Barfield

(74) *Attorney, Agent, or Firm* — Foley IP Law, PLLC

(57) ABSTRACT

A chair includes a frame configured to expand radially outward and collapse radially inward relative to a central longitudinal axis between a folded position and an open position. The frame includes front legs and at least one rear leg. A length of each of the front legs is independently adjustable between a first position and a second position that is longer than the first position. The chair includes a seat bottom held by the frame such that an angle of the seat bottom relative to a level plane is selectively adjustable between at least two different angles by adjusting the length of at least one of the front legs.

6 Claims, 8 Drawing Sheets

CHAIR AND CHAIR FRAME

BACKGROUND

Portable chairs are known to be used to provide seating for outdoor activities such as camping, hunting, fishing, spectator events (e.g., sporting events, fireworks, concerts, airshows, fairs, etc.), bird watching, picnics, and/or the like. For example, folding chairs commonly known as lawn chairs fold about the length of an axis (e.g., approximately in-half) to provide a portable chair that can be carried to the location of the activity.

SUMMARY

The following presents a simplified summary of the disclosure in order to provide a basic understanding to the reader. This summary is not intended to identify key features or essential features of the claimed subject matter nor is it intended to be used to limit the scope of the claimed subject matter. Its sole purpose is to present a selection of concepts disclosed herein in a simplified form as a prelude to the more detailed description that is presented later.

According to a first aspect there is a chair that includes a frame configured to expand radially outward and collapse radially inward relative to a central longitudinal axis between a folded position and an open position. The frame includes front legs and at least one rear leg. A length of each of the front legs is independently adjustable between a first position and a second position that is longer than the first position. The chair includes a seat bottom held by the frame such that an angle of the seat bottom relative to a level plane is selectively adjustable between at least two different angles by adjusting the length of at least one of the front legs.

According to a second aspect there is a chair that includes a frame configured to expand radially outward and collapse radially inward relative to a central longitudinal axis between a folded position and an open position. The frame includes front legs and at least one rear leg. A length of each of the front legs is independently adjustable between at least two different lengths. The chair includes a seat bottom held by the frame such that an angle of the seat bottom relative to a level plane is selectively adjustable between a first angle and a second angle by adjusting the length of at least one of the front legs. At least one of the first angle or the second angle extends obliquely to the level plane.

According to a third aspect there is a chair that includes a frame configured to expand radially outward and collapse radially inward relative to a central longitudinal axis between a folded position and an open position. The frame includes front legs and at least one rear leg. A length of each of the front legs is independently adjustable between a first position and a second position that is longer than the first position. The front legs include leg members and feet held at corresponding end portions of the leg members such that the feet are configured to pivot relative to the corresponding leg member. The chair includes a seat bottom held by the frame such that an angle of the seat bottom relative to a level plane is selectively adjustable between at least two different angles by adjusting the length of at least one of the front legs.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
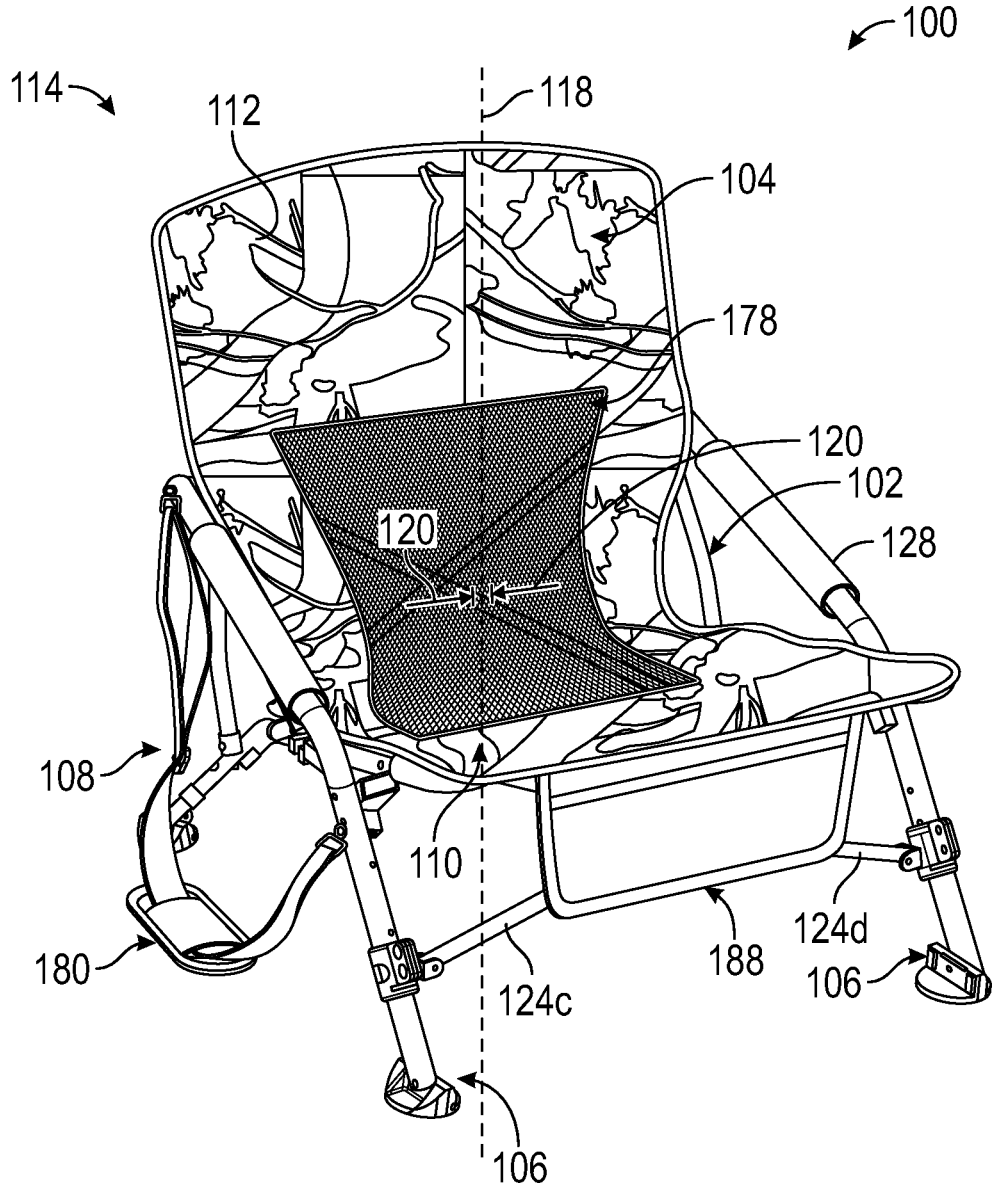
FIG. 1 is an isometric view of an exemplary chair according to an implementation.

The detailed description provided below in connection with the appended drawings is intended as a description of the present examples and is not intended to represent the only forms in which the present examples are constructed or utilized. The description sets forth the functions of the examples and the sequence of operations for constructing and operating the examples. However, the same or equivalent functions and sequences may be accomplished by different examples.

While various spatial and directional terms, such as "top," "bottom," "front," "rear," "upper," "lower," "vertical," "upward," and/or the like are used to describe implementations of the present application, it is understood that such terms are merely used with respect to the orientations shown in the drawings. The orientations can be inverted, rotated, or otherwise changed such that the spatial and directional terms apply differently, for example if the structure is flipped 180°: a top side becomes a bottom side; upward becomes downward; a left side becomes a right side; vice versa; and/or the like. Moreover, and for example, vertical may become horizontal when the structure is rotated 90°.

Portable chairs are known to be used to provide seating for outdoor activities such as camping, hunting, fishing, spectator events (e.g., sporting events, fireworks, concerts, airshows, fairs, etc.), bird watching, picnics, and/or the like. For example, folding chairs commonly known as lawn chairs fold about the length of an axis (e.g., approximately in-half) to provide a portable chair that can be carried to the location of the activity. However, a disadvantage relates to a lack of adaptability to sloping and uneven support surfaces, which are often encountered outdoors. For example, it may be difficult for a hunter to hold a gunsight in a desired orientation on uneven ground, for example while seated in the chair over a period of time.

Certain implementations provide a chair wherein the length of each of the front legs of the chair is independently adjustable between at least two different lengths. The adjustability of the front legs enables the chair to accommodate (e.g., function as a seat on, provide seating on, support a person in a seated position on, etc.) uneven ground (e.g., terrain, etc.). Moreover, and for example, the adjustability of the front legs enables the angle of a seat bottom of the chair to be selectively adjustable between at least two different angles. The lengths of the front legs may be adjusted to the select an orientation of the seat bottom that provides a predetermined seating position. For example, the orientation of the seat bottom may be selected to provide a seating position that enables a hunter to more easily hold a gunsight in a desired orientation (e.g., level, etc.) on an uneven ground segment.

Referring now to FIG. 1, according to an implementation, a chair 100 includes a frame 102 and a seat 104 held by the frame 102. In the exemplary implementation, the frame 102 includes a pair of front legs 106 and a pair of rear legs 108, however the frame 102 may include any number of front legs 106 (e.g., a single front leg 106, three front legs 106, etc.) and may include any number of rear legs 108 (e.g., a single rear leg 108, three rear legs 108, etc.). The seat 104 of the chair 100 includes a seat bottom 110 and an optional seat back 112. In the exemplary implementation, the seat 104 of the chair 100 is flexible (i.e., includes at least a flexible segment). For example, the seat 104 may include a flexible fabric, sheet, and/or the like of material. In addition or alternatively, the seat 104 may include one or more inflexible (e.g., stiff, rigid, etc.) segments. In one alternative example, the seat 104 is comprised of inflexible panels (not shown) that are configured to fold together as the chair 100 moves between the open and folded positions described below.

As will be described below, the length of each of the front legs 106 is independently adjustable between at least two different lengths (e.g., a first length and a second length that is longer than the first length, etc.). For example, the adjustability of the front legs 106 enables the chair 100 to accommodate (e.g., function as a seat on, provide seating on, support a person in a seated position on, etc.) uneven ground (e.g., terrain, etc.). Moreover, and for example, the adjustability of the front legs 106 enables the angle of the seat bottom 110 relative to a level plane 200 (FIGS. 7-9) to be selectively adjustable between at least two different angles, for example to hold the seat bottom 110 at an oblique angle relative to the level plane 200 while the chair is supported on uneven ground.

Figure 2:
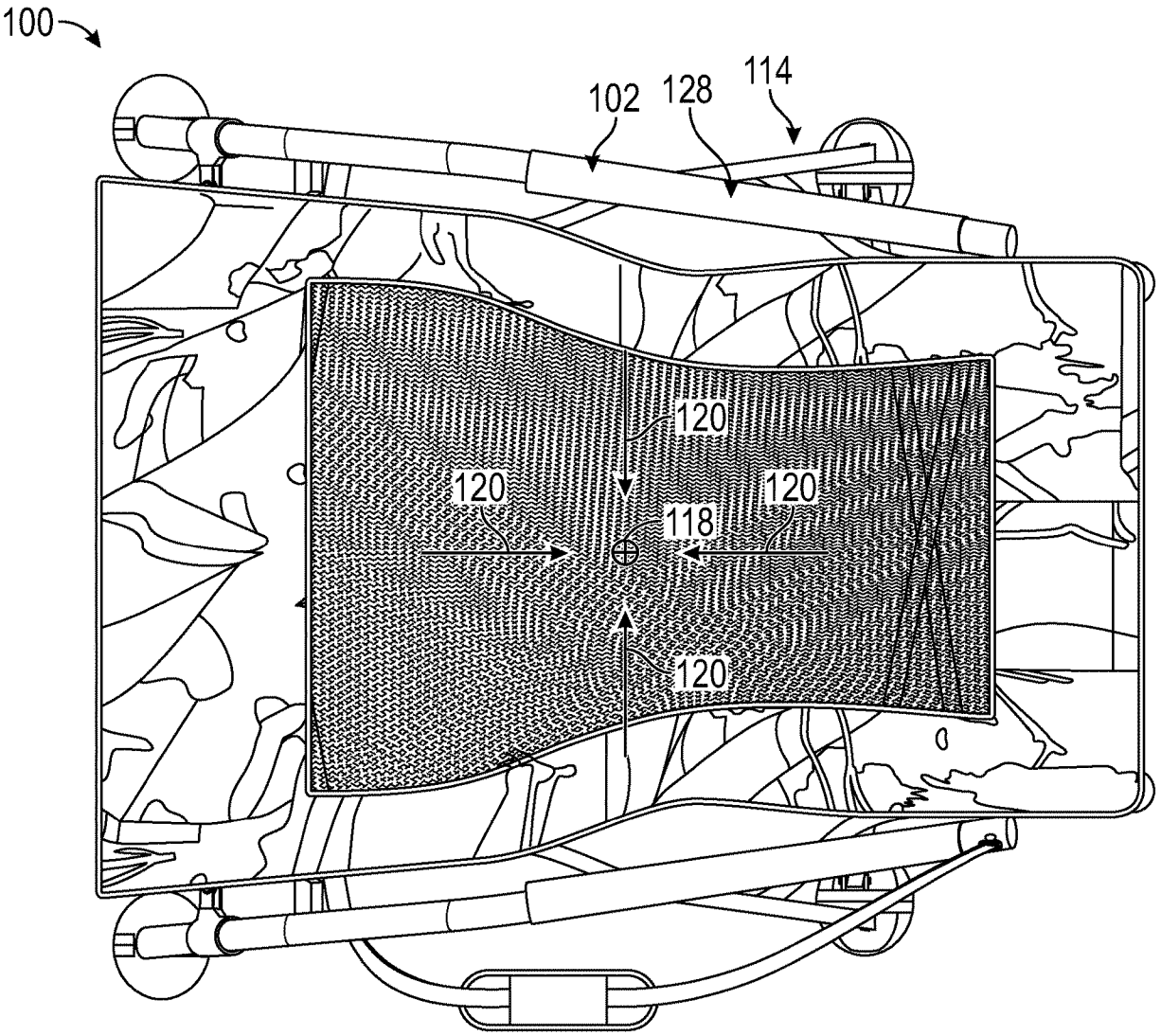
FIG. 2 is a plan view of the chair shown in FIG. 1 illustrating the chair in an open position according to an implementation.
Figure 3:
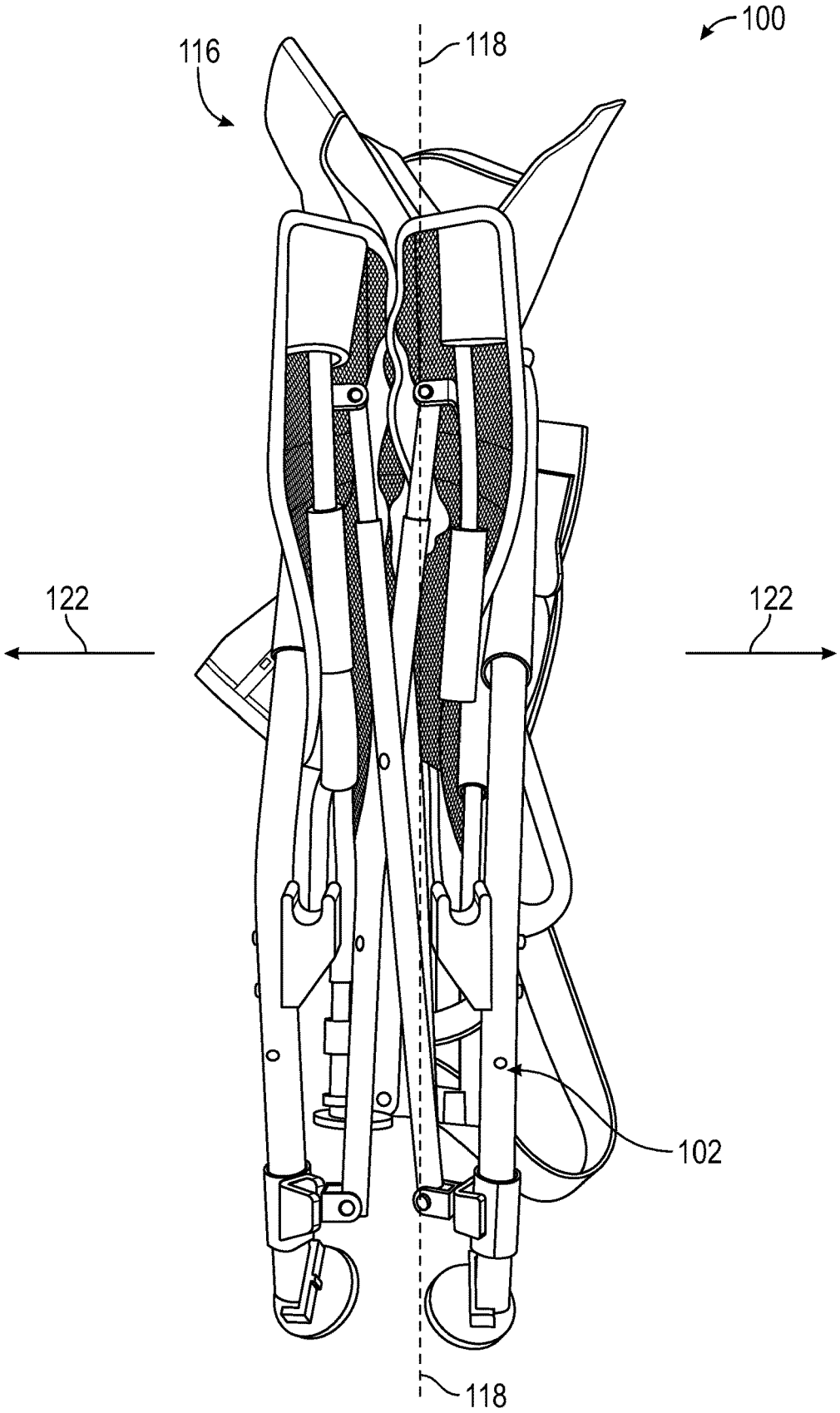
FIG. 3 is an elevational view of the chair shown in FIGS. 1 and 2 illustrating the chair in a folded position according to an implementation.

Referring now to FIGS. 1-3, the frame 102 of the chair 100 is configured to expand and collapse between an open position 114 (e.g., the open position shown in FIGS. 1 and 2, etc.) and a folded position 116 (e.g., the folded position shown in FIG. 3, etc.). For example, the frame 102 extends a length along a central longitudinal axis 118. From the open position 114 shown in FIGS. 1 and 2, the frame 102 is configured to collapse radially inward relative to the central longitudinal axis 118 toward and into the folded position shown in FIG. 3, as shown by the arrows 120. From the folded position 116 shown in FIG. 3, the frame 102 is configured to expand radially outward relative to the central longitudinal axis 118 toward and into the open position shown in FIGS. 1 and 2, as shown by the arrows 122. In the open position 114 of the frame 102, the chair 100 provides a stable platform that is capable of supporting a person in a seated position. The reduced size, footprint, form-factor, and/or the like of the frame 102 in the closed position 116 enables the chair 100 to be more easily moved, carried, stowed, and/or the like (e.g., for transportation to a location of the activity, etc.).

Figure 4:
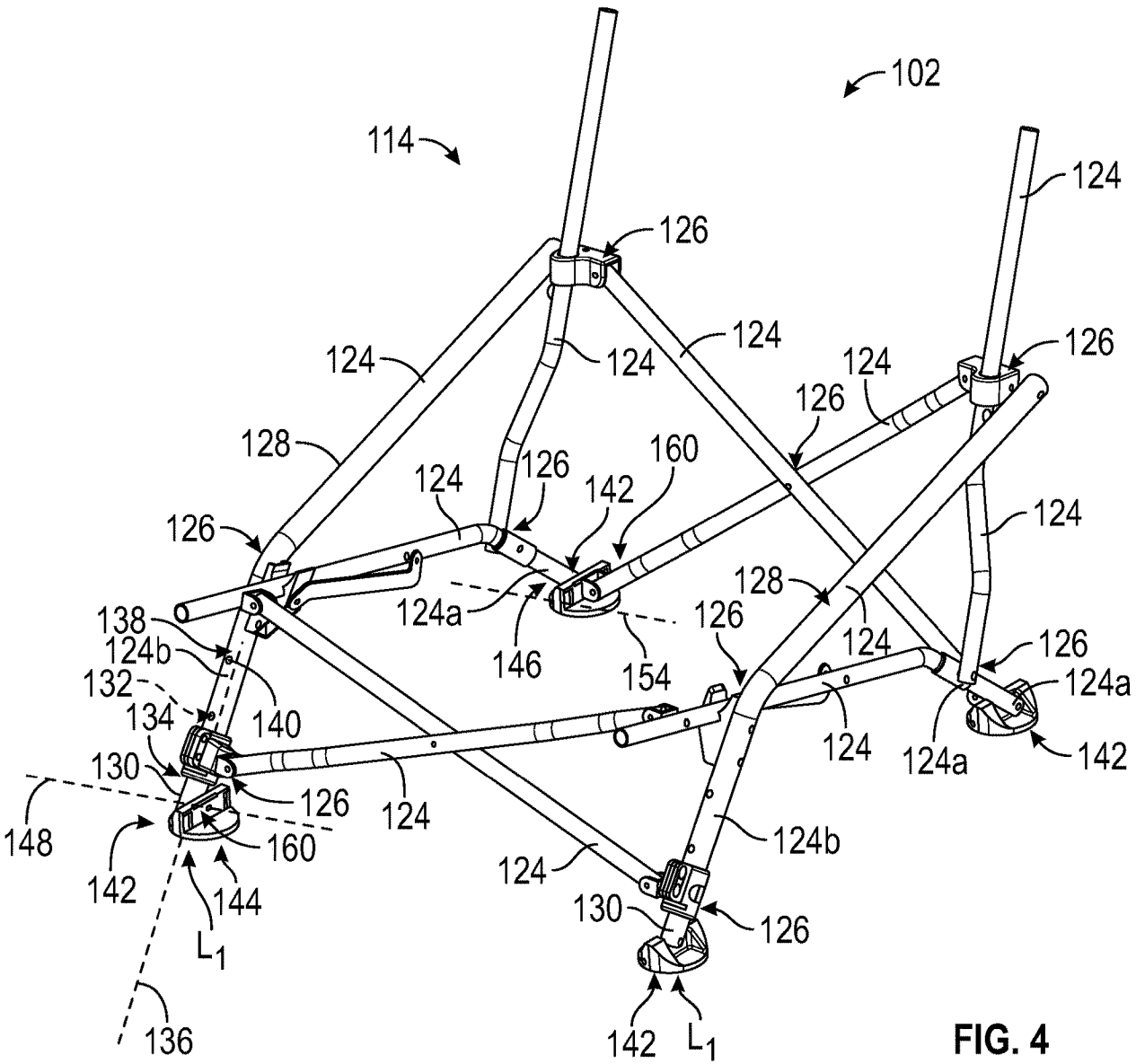
FIG. 4 is an isometric view of a frame of the chair shown in FIGS. 1-3 according to an implementation.
Figure 5:
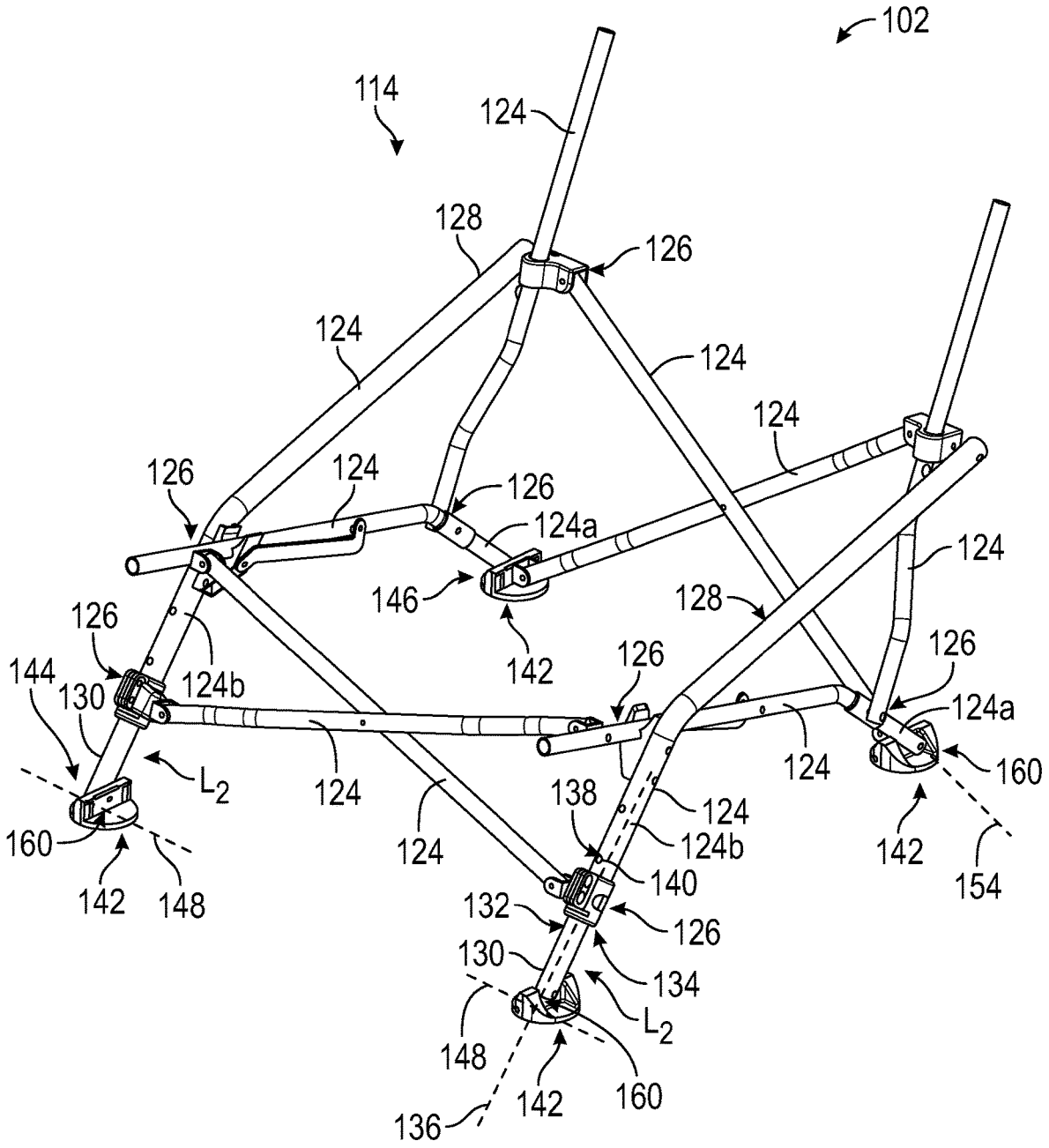
FIG. 5 is an isometric view of the frame shown in FIG. 4 illustrating a length of the front legs as extended according to an implementation.

Referring now to FIGS. 4 and 5, the frame 102 includes frame members 124 interconnected at corresponding joints 126. The joints 126 enable the frame members 124 to fold relative to each other such that the frame 102 can expand and collapse between the open position 114 and the folded position 116 (FIG. 3). In the exemplary implementation, the rear legs 108 are formed by corresponding frame members 124*a*. The exemplary implementation of the front legs 106 are formed by corresponding frame members 124*b*. In other implementations, one or more of the front legs 106 and/or one or more of the rear legs 108 is formed by a discrete structure in addition or alternative to the frame member 124*b* or 124*a*, respectively. Each of the frame members 124*a* and/or 124*b* may be referred to herein as a "leg member".

The frame 102 includes one or more arm rests 128. The exemplary implementation of the arm rests 128 are formed by corresponding frame members 124*b*. In other implementations, one or more of the arm rests 128 is formed by a discrete structure in addition or alternative to the frame member 124*b*. Although shown as being fixed in position, in some other implementations, one or more of the arm rests 128 are adjustable in one or more directions (e.g., height, width, side-to-side, front to back, etc.). Optionally, one or more of the arm rests 128 is padded, for example as is shown in FIGS. 1-3.

In addition to the frame members 124*b*, the front legs 106 also include leg members 130. In the exemplary implementation, the frame members 124*b* and the leg members 130 cooperate to enable the length of the front leg 106 to be adjusted. Although any other arrangement, geometry, structure, means, and/or the like may be used, the exemplary implementation includes a telescoping arrangement between the frame members 124*b* and the leg members 130. For example, an end portion 132 of the leg member 130 is received into an open end portion 134 of the frame member 124*b* such that the leg member 130 is configured to telescope (e.g., slide, move axially relative to the frame member 124*b*, etc.) inwardly and outwardly along a central longitudinal axis 136 of the front leg 106 between the at least two different lengths. In some other implementations, the end portion 134 of the frame member 124*b* is received into the end portion 132 of the leg member 130.

Although only two different lengths of each front leg 106 are shown herein, each front leg 106 may be independently adjustable between any number of different lengths and/or positions (e.g., three different lengths, four different lengths, a continuous and/or full range of adjustment along a finite length, etc.). In the exemplary implementation, FIG. 4 illustrates a first length (i.e., position) $L_1$ of the front legs 106 and FIG. 5 illustrates a second length (i.e., position) $L_2$ of the front legs 106. As can be seen from a comparison of FIGS. 4 and 5, the dimension of the second length $L_2$ is greater than the dimension of the first length $L_1$ such that the second length $L_2$ is longer than the first length $L_1$ (i.e., the first length $L_1$ is shorter than the second length $L_2$). The first length $L_1$ may be referred to herein as a "first position". The second length $L_2$ may be referred to herein as a "second position".

Each front leg 106 is selectively adjustable between the first length $L_1$ and the second length $L_2$. The exemplary implementations of the front legs 106 include corresponding latch pins 138 that hold the front legs 106 in the positions of the first length $L_1$ and the second length $L_2$. The latch pins 138 are spring-loaded pins that extend outward from the leg member 130 and cooperate with corresponding openings 140 within the frame member 124*b* to hold the front legs 106 in the respective first and second lengths $L_1$ and $L_2$. The latch pins 138 are biased to extend through the corresponding openings 140 of the frame member 124*b* to hold the front legs 106 in the first length $L_1$ or the second length $L_2$. Each latch pin 138 can be pushed back through the opening 140 to enable adjustment of the front leg 106 to the position that corresponds to a different length. In addition or alternative to the latch pins 138 and/or the openings 140, any other arrangement, geometry, structure, means, and/or the like may be used. For example, a clamp (not shown) may be used to hold the front legs 106 in the positions of the first length $L_1$ and the second length $L_2$. In some examples, a clamp and/or other mechanism may enable the front legs 106 to be held at any position along the length thereof between the first length $L_1$ and the second length $L_2$ (e.g., enable a continuous and/or full range of adjustment from the first length $L_1$ to the second length $L_2$ and vice versa, etc.).

In the exemplary implementation, the lengths of each of the rear legs 108 is fixed. In other words, the lengths of the exemplary rear legs 108 are not selectively adjustable. In other implementations, the length of one or more of the rear legs 108 is independently adjustable between at least two different lengths (e.g., a first length and a second length that is longer than the first length, etc.). Providing adjustment of the lengths of one or more of the rear legs 108 may enable the chair 100 to accommodate especially uneven ground (e.g., rocky terrain, etc.).

The front legs 106 and the rear legs 108 of the frame 102 include corresponding feet 142. For example, the feet 142 are positioned at respective end portions 144 and 146 of the front legs 106 and the rear legs 108. The leg members 130 of the front legs 106 include the end portions 144, and thus the feet 142. The feet 142 are configured to pivot relative to the corresponding leg 106 and 108. For example, the feet 142 of the front legs 106 are configured to pivot relative to the leg member 130 of the corresponding front leg 106 about at least one axis. In the exemplary implementation, the feet 142 of the front legs 106 pivot about an axis 148. The exemplary implementation of the feet 142 of the rear legs 108 pivot about an axis 154. In other implementations, the foot 142 of one or more of the front legs 106 and/or the foot 142 of one or more of the rear legs 108 pivot about at least two different axes (e.g., two axes, three axes, four axes, etc.).

In the exemplary implementation, the pivoting action of the feet 142 is provided by a corresponding hinge 160. For example, the hinge 160 extends along the corresponding axis 148 or 154 such that the hinge 160 enables each foot 142 to pivot about the corresponding axis 148 or 154. Any other arrangement, geometry, structure, means, and/or the like may be additionally or alternatively used to provide the pivoting action of the feet 142, such as, but not limited to, a clevis, a pin, a spherical rod end, a ball joint, and/or the like.

Figure 6:
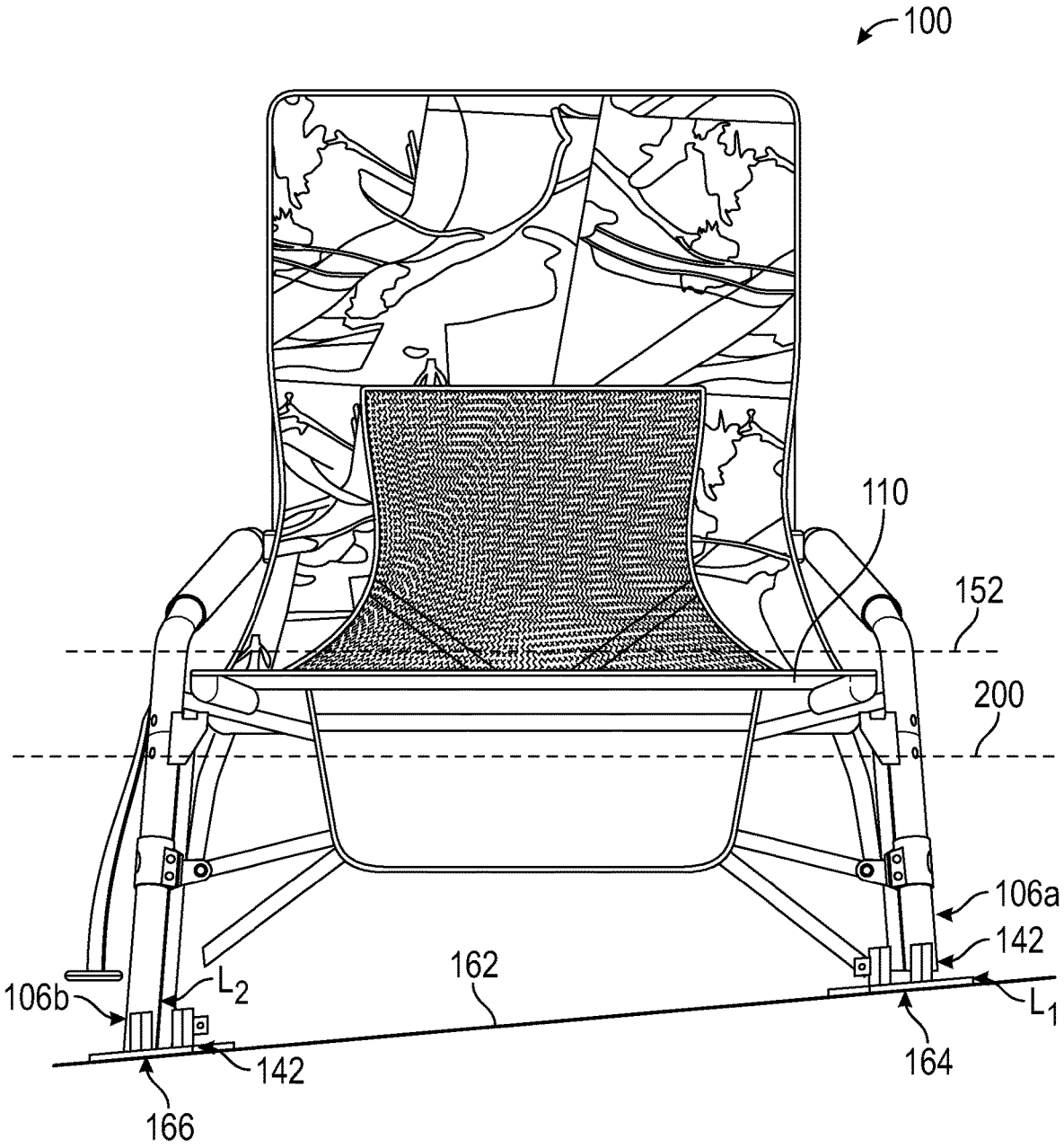
FIG. 6 is a front elevational view of the chair shown in FIGS. 1 and 2 resting on uneven ground according to an implementation.

Referring now to FIG. 6, and as briefly described above, the adjustability of the front legs 106 enables the chair 100 to accommodate (e.g., function as a seat on, provide seating on, support a person in a seated position on, etc.) uneven ground. For example, FIG. 6 illustrates the chair 100 resting on a segment 162 of uneven ground that is sloped (e.g., angled, etc.) relative to the level plane 200. The foot 142 of the front leg 106*a* rests on the ground segment 162 at a first location 164 and the foot 142 of the front leg 106*b* rests on the ground segment 162 at a second location 166. As illustrated by FIG. 6, the second location 166 is lower in elevation as compared to the first location 164. The front leg 106*a* is positioned at the first length $L_1$ and the front leg 106*b* is positioned at the second length $L_2$. The different dimensions of the first length $L_1$ and the second length $L_2$ of the front legs 106*a* and 106*b*, respectively, accommodate the different elevations of the first location 164 and the second location 166.

Accordingly, the front legs 106*a* and 106*b* support and hold the seat bottom 110 in a stable orientation (e.g., relative to the level plane 200, etc.) that is capable of supporting a person in a seated position on the ground segment 162. For example, in the exemplary implementation, the different lengths of the front legs 106*a* and 106*b* enable the chair 100 to be supported on the ground segment 162 with the seat bottom 110 extending approximately level from side-to-side. In other words, the seat bottom 110 is shown in FIG. 6 with a latitudinal axis 152 of the seat bottom 110 extending approximately parallel with the level plane 200. However, the lengths of the front legs 106*a* and 106*b* of the chair 100 may be selected to provide the seat bottom 110 with any other orientation, such as, but not limited to, an oblique orientation, an orientation wherein the latitudinal axis 152 of the seat bottom 110 extends between approximately 1° and approximately 15° relative to the level plane 200, and/or the like. As shown in FIG. 6, the feet 142 of the front legs 106*a* and 106*b* have pivoted to accommodate the slope of the grounds segment 162.

The lengths of the front legs 106*a* and 106*b* may be adjusted to the select an orientation of the seat bottom 110 that provides a predetermined seating position. For example, the orientation of the seat bottom 110 may be selected to provide a seating position that enables a hunter to more easily hold a gunsight in a desired orientation (e.g., level, etc.) on the uneven ground segment 162.

Figure 7:
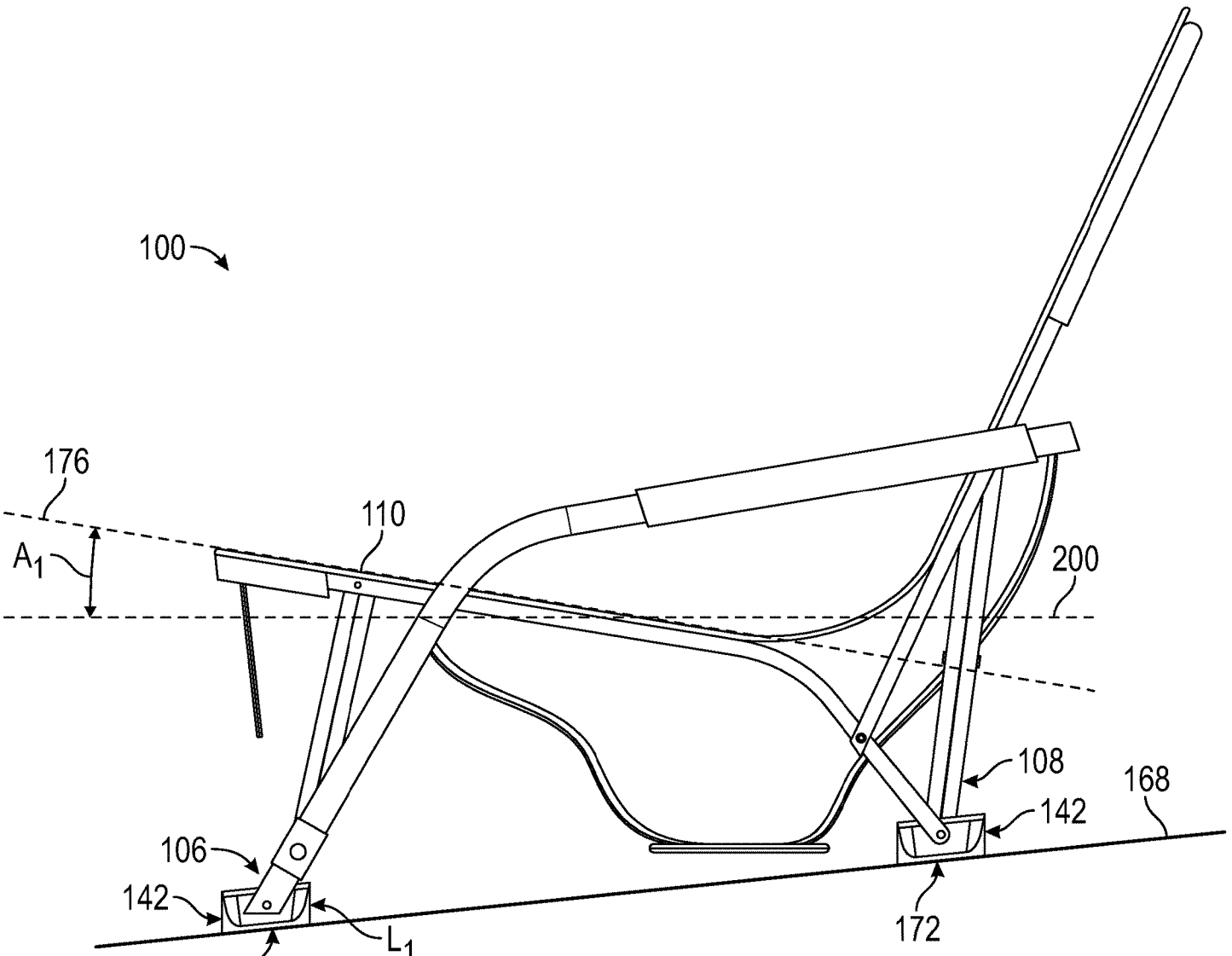
FIG. 7 is a side elevational view of the chair shown in FIGS. 1 and 2 resting on uneven ground according to an implementation.
Figure 8:
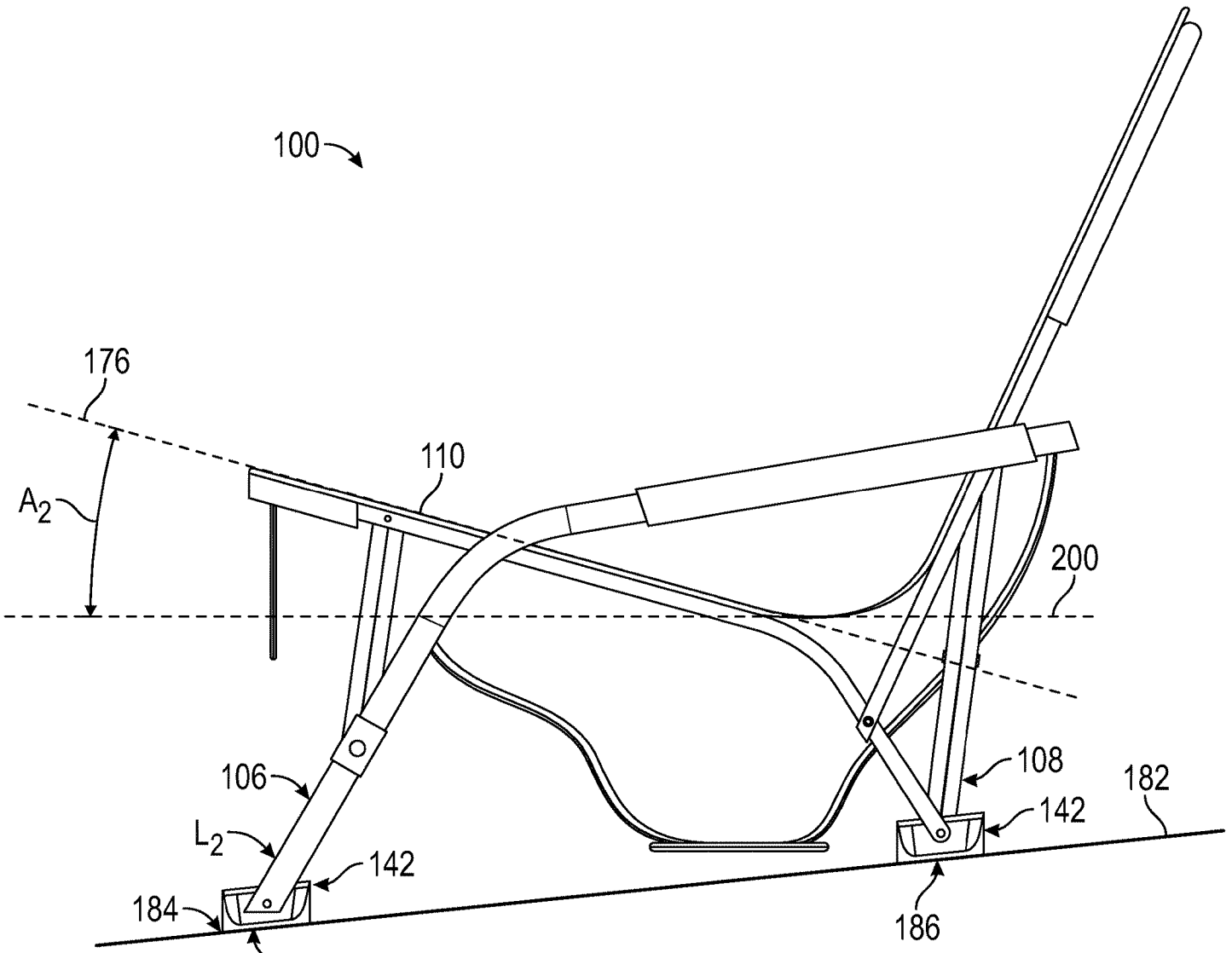
FIG. 8 is a side elevational view of the chair shown in FIGS. 1 and 2 resting on uneven ground according to an implementation.

Referring now to FIGS. 7 and 8, the adjustability of the front legs 106 enables the angle of the seat bottom 110 relative to a level plane 200 to be selectively adjustable between at least two different angles, for example to hold the seat bottom 110 at an oblique angle relative to the level plane 200 on uneven ground. For example, in FIG. 7, the chair 100 rests on a segment 168 of uneven ground that is sloped (e.g., angled, etc.) relative to the level plane 200. The feet 142 of the front legs 106 rest on the ground segment 168 at locations 170 and the feet 142 of the rear legs 108 rest on the ground segment 168 at locations 172. As illustrated by FIG. 7, the locations 170 are lower in elevation as compared to the locations 172. The front legs 106 are each positioned at the first length $L_1$ thereof. The position of the front legs 106 at the first length $L_1$ relative to the fixed length of the rear legs 108 accommodates the different elevations of the respective locations 170 and 172. Accordingly, the front legs 106 support and hold the seat bottom 110 in a stable orientation (e.g., relative to the level plane 200, etc.) that is capable of supporting a person in a seated position on the ground segment 168. As shown in FIG. 7, the feet 142 of the front legs 106 and the feet 142 of the rear legs 108 have pivoted to accommodate the slope of the ground segment 168.

In FIG. 8, the chair 100 rests on a segment 182 of uneven ground that is sloped (e.g., angled, etc.) relative to the level plane 200. The feet 142 of the front legs 106 rest on the ground segment 182 at locations 184 and the feet 142 of the rear legs 108 rest on the ground segment 182 at locations 186. As illustrated by FIG. 8, the locations 184 are lower in elevation as compared to the locations 186. The front legs 106 are each positioned at the second length $L_2$ thereof. The position of the front legs 106 at the second length $L_2$ relative to the fixed length of the rear legs 108 accommodates the different elevations of the respective locations 184 and 186.

Accordingly, the front legs 106 support and hold the seat bottom 110 in a stable orientation (e.g., relative to the level plane 200, etc.) that is capable of supporting a person in a seated position on the ground segment 182. As shown in FIG. 8, the feet 142 of the front legs 106 and the feet 142 of the rear legs 108 have pivoted to accommodate the slope of the ground segment 182.

The adjustability of the front legs 106 between the first length $L_1$ and the second length $L_2$ enables the angle of the seat bottom 110 relative to the level plane 200 to be selectively adjustable between a first angle $A_1$ (shown in FIG. 7) and a second angle $A_2$ (shown in FIG. 8). In other words, the seat bottom 110 is shown in FIGS. 7 and 8 with a longitudinal axis 176 of the seat bottom 110 extending at the angles $A_1$ and $A_2$, respectively, relative to the level plane 200. In the exemplary implementation, the angles $A_1$ and $A_2$ are each oblique to the level plane 200. In other words, the longitudinal axis 176 of the seat bottom 110 extends obliquely to the level plane 200 when positioned at the angles $A_1$ and $A_2$. However, the lengths of the front legs 106 may be selected to provide the seat bottom 110 with any other orientation, such as, but not limited to, an orientation wherein the longitudinal axis 176 of the seat bottom extends approximately parallel to the level plane 200, an orientation wherein the longitudinal axis 176 of the seat bottom 110 extends between approximately 5° and approximately 50° relative to the level plane 200, and/or the like. Although only two angles $A_1$ and $A_2$ are shown herein, the seat bottom 110 may be adjustable between any number of different angles (e.g., three different angles, four angles, etc.).

The angle of the seat bottom 110 relative to the level plane 200 may be selected to provide an orientation of the seat bottom 110 that provides a predetermined seating position. For example, the orientation of the seat bottom 110 may be selected to provide a seating position that enables a hunter to more easily hold a gunsight in a desired orientation (e.g., level, etc.) on the uneven ground segment 168.

Optionally, the lengths of the front legs 106 extend obliquely relative to the level plane 200. For example, in the exemplary implementation the lengths of the front legs 106 are angled at an oblique angle $A_3$ that extends at approximately 60° relative to the level plane 200. However, the lengths of the front legs 106 may extend at any other angle relative to the level plane 200, such as, but not limited to, between approximately 30° and approximately 80° relative to the level plane 200, approximately perpendicular to the level plane 200, and/or the like. In some implementations, an oblique angle of the lengths of the front legs 106 relative to the level plane 200 enables may expand the range of adjustment of the angle of the seat bottom 110 relative to the level plane 200.

Referring again to FIG. 1, optionally, the seat bottom 110 and/or the seat back 112 includes a mesh segment 178, for example to allow air to flow through the seat 104. The mesh segment 178 extends along a portion of both the seat bottom 110 and the seat back 112 in the exemplary implementation. However, the mesh segment 178 may extend along only the seat bottom 110 or only along the seat back 112 in other implementations. The mesh segment 178 may have any size, geometry, and/or the like in addition or alternatively what is shown herein. Although only one is shown, the chair 100 may include any number of the mesh segments 178.

The chair 100 optionally includes a carrying strap 180 that enables a user to carry the chair 100 one their person, for example by looping the carrying strap 180 over the user's shoulder. In the exemplary implementation, the carrying strap 180 hangs from the frame member **124*b*, but the carrying strap 180 may additionally or alternatively be connected to the chair 100 at any other location along the frame 102, the seat 104, and/or the like. Although only one is shown, the chair 100 may include any number of the carrying straps 180**.

An optional flap pocket 188 is provided in the exemplary implementation of the chair 100. For example, the flap pocket 188 hangs from the front of the seat bottom 110 and is connected to frame members **124*c* and 124*d* of the frame 102. Accordingly, the flap pocket 188 is located at the front of the chair 100 in the exemplary implementation. However, the flap pocket 188 may have any other location along the chair 100 in addition or alternatively to the front. The chair 100 may include any number of the flap pockets 188**, even though only one is shown herein.

The following clauses describe further aspects:

Clause Set A

A1. A chair comprising:

a frame configured to expand radially outward and collapse radially inward relative to a central longitudinal axis between a folded position and an open position, the frame comprising front legs and at least one rear leg, a length of each of the front legs being independently adjustable between a first position and a second position that is longer than the first position; and a seat bottom held by the frame such that an angle of the seat bottom relative to a level plane is selectively adjustable between at least two different angles by adjusting the length of at least one of the front legs.

A2. The chair of any preceding clause, wherein a length of the at least one rear leg is fixed.

A3. The chair of any preceding clause, wherein at least one of the at least two different angles of the seat bottom comprises between approximately 5° and approximately 50° relative to the level plane.

A4. The chair of any preceding clause, wherein the lengths of the front legs extend obliquely relative to the level plane.

A5. The chair of any preceding clause, wherein the lengths of the front legs are angled between approximately 30° and approximately 80° relative to the level plane.

A6. The chair of any preceding clause, wherein each of the front legs is configured to telescope inwardly and outwardly along a central longitudinal axis of the front leg between the first position and the second position.

A7. The chair of any preceding clause, wherein at least one of the at least two different angles of the seat bottom extends obliquely to the level plane.

A8. The chair of any preceding clause, wherein at least one of the at least two different angles of the seat bottom extends obliquely to the level plane, the frame being configured to hold the seat bottom in the at least two different angles when the frame is supported by uneven ground.

A9. The chair of any preceding clause, wherein the front legs comprise leg members and feet held at corresponding end portions of the leg members such that the feet are configured to pivot relative to the corresponding leg member.

A10. The chair of any preceding clause, wherein the front legs comprise leg members and feet mounted to the leg members at corresponding joints, the joints comprising at least one of a hinge, a clevis, a pin, a spherical rod end, or a ball joint.

A11. The chair of any preceding clause, wherein at least one of the front legs comprises a leg member defining at least a portion of the length of the front leg, the leg member comprising an arm rest of the frame.

A12. The chair of any preceding clause, wherein the seat bottom comprises a flexible segment.

A13. The chair of any preceding clause, further comprising at least one of a mesh segment of at least one of the seat bottom or a seat back, a carrying strap, a flap pocket, or a padded arm rest.

Clause Set B

B1. A chair comprising:

a frame configured to expand radially outward and collapse radially inward relative to a central longitudinal axis between a folded position and an open position, the frame comprising front legs and at least one rear leg, wherein a length of each of the front legs is independently adjustable between at least two different lengths; and a seat bottom held by the frame such that an angle of the seat bottom relative to a level plane is selectively adjustable between a first angle and a second angle by adjusting the length of at least one of the front legs, wherein at least one of the first angle or the second angle extends obliquely to the level plane.

B2. The chair of any preceding clause, wherein at least one of the first angle or the second angle of the seat bottom comprises between approximately 5° and approximately 50° relative to the level plane.

B3. The chair of any preceding clause, wherein the lengths of the front legs extend obliquely relative to the level plane.

B4. The chair of any preceding clause, wherein the lengths of the front legs are angled between approximately 30° and approximately 80° relative to the level plane.

B5. The chair of any preceding clause, wherein the length of each of the front legs is adjustable between a first position and a second position that is longer than the first position.

B6. The chair of any preceding clause, wherein each of the front legs is configured to telescope inwardly and outwardly along a central longitudinal axis of the front leg between the at least two different lengths.

B7. The chair of any preceding clause, wherein the first angle extends obliquely to the level plane, the frame being configured to hold the seat bottom in the first angle when the frame is supported by uneven ground.

B8. The chair of any preceding clause, wherein the frame is configured to hold the seat bottom in the first angle when the frame is supported by uneven ground, the frame being further configured to hold the seat bottom in the second angle when the frame is supported by the uneven ground.

B9. The chair of any preceding clause, wherein a length of the at least one rear leg is fixed.

B10. The chair of any preceding clause, wherein the front legs comprise leg members and feet held at corresponding end portions of the leg members such that the feet are configured to pivot relative to the corresponding leg member.

B11. The chair of any preceding clause, wherein the front legs comprise leg members and feet mounted to the leg members at corresponding joints, the joints comprising at least one of a hinge, a clevis, a pin, a spherical rod end, or a ball joint.

B12. The chair of any preceding clause, wherein at least one of the front legs comprises a leg member defining at least a portion of the length of the front leg, the leg member comprising an arm rest of the frame.

B13. The chair of any preceding clause, wherein the seat bottom comprises a flexible segment.

B14. The chair of any preceding clause, further comprising at least one of a mesh segment of at least one of the seat bottom or a seat back, a carrying strap, a flap pocket, or a padded arm rest.

Clause Set C

C1. A chair comprising:

a frame configured to expand radially outward and collapse radially inward relative to a central longitudinal axis between a folded position and an open position, the frame comprising front legs and at least one rear leg, a length of each of the front legs being independently adjustable between a first position and a second position that is longer than the first position, wherein the front legs comprise leg members and feet held at corresponding end portions of the leg members such that the feet are configured to pivot relative to the corresponding leg member; and a seat bottom held by the frame such that an angle of the seat bottom relative to a level plane is selectively adjustable between at least two different angles by adjusting the length of at least one of the front legs.

C2. The chair of any preceding clause, wherein the feet are mounted to the end portions of the leg members at corresponding joints comprising at least one of a hinge, a clevis, a pin, a spherical rod end, or a ball joint.

C3. The chair of any preceding clause, wherein a length of the at least one rear leg is fixed.

C4. The chair of any preceding clause, wherein at least one of the at least two different angles of the seat bottom comprises between approximately 5° and approximately 50° relative to the level plane.

C5. The chair of any preceding clause, wherein the lengths of the front legs extend obliquely relative to the level plane.

C6. The chair of any preceding clause, wherein the lengths of the front legs are angled between approximately 30° and approximately 80° relative to the level plane.

C7. The chair of any preceding clause, wherein each of the front legs is configured to telescope inwardly and outwardly along a central longitudinal axis of the front leg between the first position and the second position.

C8. The chair of any preceding clause, wherein at least one of the at least two different angles of the seat bottom extends obliquely to the level plane.

C9. The chair of any preceding clause, wherein at least one of the at least two different angles of the seat bottom extends obliquely to the level plane, the frame being configured to hold the seat bottom in the at least two different angles when the frame is supported by uneven ground.

C10. The chair of any preceding clause, wherein at least one of the front legs comprises a leg member defining at least a portion of the length of the front leg, the leg member comprising an arm rest of the frame.

C11. The chair of any preceding clause, wherein the seat bottom comprises a flexible segment.

C12. The chair of any preceding clause, further comprising at least one of a mesh segment of at least one of the seat bottom or a seat back, a carrying strap, a flap pocket, or a padded arm rest.

Clause Set D

D1. A method for configuring a seating position of a chair, the method comprising:

expanding a frame of the chair radially outward relative to a central longitudinal axis of the chair to an open position of the chair; and adjusting an angle of a seat bottom of the chair relative to a level plane by adjusting a length of at least one front leg of the chair such that the angle of the seat bottom extends obliquely to the level plane.

D2. The method of any preceding clause, wherein adjusting the angel of the seat bottom comprises adjusting a length of at least one front leg of the chair such that the angle of the seat bottom extends obliquely to the level plane when the chair is supported on uneven ground.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Any range or value given herein can be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one implementation or can relate to several implementations. The implementations are not limited to those that solve any or all of the stated problems or those that have any or all of the stated benefits and advantages. It will further be understood that reference to 'an' item refers to one or more of those items.

The order of execution or performance of the operations in examples of the present application illustrated and described herein is not essential, unless otherwise specified. That is, the operations can be performed in any order, unless otherwise specified, and examples of the application can include additional or fewer operations than those disclosed herein. For example, it is contemplated that executing or performing a particular operation before, contemporaneously with, or after another operation (e.g., different steps, etc.) is within the scope of aspects and implementations of the application.

The term "comprising" is used in this specification to mean including the feature(s) or act(s) followed thereafter, without excluding the presence of one or more additional features or acts. The terms "comprising." "including." and "having" are intended to be inclusive and mean that there can be additional elements other than the listed elements. In other words, the use of "including." "comprising." "having." "containing." "involving." and variations thereof, is meant to encompass the items listed thereafter and additional items. Accordingly, and for example, unless explicitly stated to the contrary, implementations "comprising" or "having" an element or a plurality of elements having a particular property can include additional elements not having that property. Further, references to "one implementation" or "an implementation" are not intended to be interpreted as excluding the existence of additional implementations that also incorporate the recited features. The term "exemplary" is intended to mean "an example of".

When introducing elements of aspects of the application or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." Accordingly, and for example, as used herein, an element or step recited in the singular and preceded by the word "a" or "an" should be understood as not necessarily excluding the plural of the elements or steps.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used in the specification and in the claims, "or" should be understood to have the same meaning as "and/or" as defined above. For example, when separating items in a list. "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either" "one of" "only one of" or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the application in detail, it will be apparent that modifications and variations are possible without departing from the scope of aspects of the application as defined in the appended claims. As various changes could be made in the above constructions, products, and methods without departing from the scope of aspects of the application, it is intended that all matter contained in the above description and shown in the accompanying drawings shall be interpreted as illustrative and not in a limiting sense.

It is to be understood that the above description is intended to be illustrative, and not restrictive. For example, the above-described implementations (and/or aspects thereof) can be used in combination with each other. In addition, many modifications can be made to adapt a particular situation or material to the teachings of the various implementations of the application without departing from their scope. While the dimensions and types of materials described herein are intended to define the parameters of the various implementations of the application, the implementations are by no means limiting and are example implementations. Many other implementations will be apparent to those of ordinary skill in the art upon reviewing the above description. The scope of the various implementations of the application should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various implementations of the application, including the best mode, and also to enable any person of ordinary skill in the art to practice the various implementations of the application, including making and using any devices or systems and performing any incorporated methods. The patentable scope of the various implementations of the application is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A chair comprising:

a frame configured to expand radially outward and collapse radially inward relative to a central longitudinal axis between a folded position and an open position, the frame comprising:

two front legs each configured to be independently adjustable between a plurality of different lengths to extend a length of each of the two front legs independently and obliquely relative to a level plane, wherein each of the two front legs comprises a leg member and a foot held at a corresponding end portion of the leg member, the foot being mounted to the leg member at a joint comprising a ball joint, a clevis, or a spherical rod end, the joint allowing rotation about at least two perpendicular axes to enable the foot to conform to uneven terrain; and two rear legs each having a fixed length, wherein each of the two rear legs comprises a leg member and a foot held at a corresponding end portion of the leg member, the foot being mounted to the leg member at a joint comprising the ball joint, the clevis, or the spherical rod end, the joint allowing the rotation about the at least two perpendicular axes to enable the foot to conform to the uneven terrain; and a seat bottom secured by the frame and configured to be selectively adjustable between at least two different angles relative to the level plane in conjunction with independently adjusting the length of the two front legs, wherein at least one of the at least two different angles of the seat bottom extends obliquely relative to the level plane.

2. The chair of claim 1, wherein the lengths of the front legs are angled between approximately 30° and approximately 80° relative to the level plane.

3. The chair of claim 1, wherein each of the front legs is configured to telescope inwardly and outwardly along a central longitudinal axis of the front leg between the first position and the second position.

4. The chair of claim 1, wherein at least one of the front legs comprises a leg member defining at least a portion of the length of the front leg, the leg member comprising an arm rest of the frame.

5. The chair of claim 1, wherein the seat bottom comprises a flexible segment.

6. The chair of claim 1, further comprising at least one of a mesh segment of at least one of the seat bottom or a seat back, a carrying strap, a flap pocket, or a padded arm rest.

* * * * *